US007347055B2

(12) United States Patent
Lucas

(10) Patent No.: US 7,347,055 B2
(45) Date of Patent: Mar. 25, 2008

(54) RAPID CHILLING APPARATUS AND METHOD FOR A BEVERAGE-FILLED CONTAINER

(75) Inventor: Philip J. Lucas, Golden, CO (US)

(73) Assignee: Coors Global Properties, Inc., Lakewood, CO (US)

( * ) Notice: Subject to any disclaimer, the term of this patent is extended or adjusted under 35 U.S.C. 154(b) by 316 days.

(21) Appl. No.: 11/268,189

(22) Filed: Nov. 7, 2005

(65) Prior Publication Data

US 2007/0101734 A1 May 10, 2007

(51) Int. Cl.
*F25D 25/00* (2006.01)
*F25D 3/08* (2006.01)

(52) U.S. Cl. ..... 62/62; 62/457.4

(58) Field of Classification Search ..... 62/62, 62/371, 394, 457.1, 457.4, 457.8, 457.9; 220/592.16, 592.17; 165/80.5
See application file for complete search history.

(56) References Cited

U.S. PATENT DOCUMENTS 1,904,980 A * 4/1933 Hull ..... 62/125
3,469,415 A * 9/1969 Cornelius ..... 62/394
3,875,759 A * 4/1975 Malcosky et al. ..... 62/394
4,597,271 A 7/1986 Nof
4,669,273 A * 6/1987 Fischer et al. ..... 62/294
4,742,939 A * 5/1988 Galockin ..... 222/68
5,372,017 A * 12/1994 Zorea et al. ..... 62/457.9
5,609,038 A 3/1997 Halimi
5,653,123 A 8/1997 Handlin
5,845,501 A * 12/1998 Stonehouse et al. ..... 62/62
6,050,104 A 4/2000 Corona
6,073,452 A 6/2000 Karp et al.
6,082,114 A * 7/2000 Leonoff ..... 62/3.64
6,185,942 B1 2/2001 Werrbach, III et al.
6,237,360 B1 5/2001 Corona
6,442,961 B1 9/2002 Rosenberg et al.
6,446,460 B1 9/2002 Rosenberg
6,530,235 B2 * 3/2003 Halimi et al. ..... 62/62
6,571,564 B2 * 6/2003 Upadhye et al. ..... 62/3.3

FOREIGN PATENT DOCUMENTS

WO WO 96/31743 * 10/1995

* cited by examiner

*Primary Examiner*—Mohammad M. Ali
(74) *Attorney, Agent, or Firm*—Klaas, Law, O'Meara & Malkin, P.C.; William P. O'Meara; Nellie C. Kaufman

(57) ABSTRACT

An apparatus and method for rapidly chilling a beverage-filled container and the beverage therein is disclosed. The apparatus includes a housing having a cylindrical inner surface that generally conforms to the cylindrical outer surface of a beverage-filled container. A cooling coil surrounds the housing, and a refrigeration unit is operatively connected thereto. When a beverage-filled container is positioned within the housing, the beverage-filled container and the beverage therein is rapidly chilled substantially by conduction.

15 Claims, 7 Drawing Sheets

RAPID CHILLING APPARATUS AND METHOD FOR A BEVERAGE-FILLED CONTAINER

FIELD OF THE INVENTION

The present invention relates generally to refrigeration systems, and, in particular, to an apparatus and method for rapidly chilling a beverage-filled container and the beverage therein.

BACKGROUND OF THE INVENTION

Beverages such as beer may be packaged in containers such as aluminum cans or glass bottles. A retailer will typically store such containers in a refrigerator that maintains the temperature of the beverage therein at about 40 degrees F. However, a beverage such as beer is generally more desirable to a consumer when it is at a reduced temperature, for example, at about 32 degrees F. In addition to tasting more refreshing, a beverage such as beer at a reduced temperature does not produce as much foam when the container is opened.

A basic convection refrigeration unit consists of a compressor that compresses refrigerant in a gaseous form and sends it to a condenser, which removes heat from the gas and allows it to condense into a liquid. The liquid refrigerant is then sent through a device that causes a drop in the pressure thereof, and then it is sent through an evaporator consisting of cooling coils. Air flow within a refrigerator compartment, which may be enhanced with the use of a fan, allows the refrigerant in the cooling coils to absorb heat from the surrounding area in a refrigerator compartment, thereby chilling products stored therein through the heat transfer method known as convection. The heated refrigerant, which is converted to a gaseous form in the evaporator, is then sent back to the compressor in order to complete the cycle.

While convection effectively chills beverage-filled containers stored in a refrigerator compartment, a more rapid and efficient method of chilling a beverage-filled container to a reduced temperature that is more desirable to a consumer would be through another heat transfer method known as conduction. Thus, it would be generally desirable to provide a low-cost refrigeration unit that primarily uses conduction in order to rapidly chill a beverage-filled container and the beverage therein.

SUMMARY OF THE INVENTION

The present invention is directed to an apparatus for rapidly chilling a beverage-filled container and the beverage therein. The apparatus includes a housing having a cylindrical inner surface that generally conforms to the cylindrical outer surface of a beverage-filled container. A cooling coil surrounds the housing, and a refrigeration unit is operatively connected thereto. When a beverage-filled container is positioned within the housing, the beverage-filled container and beverage therein are rapidly chilled substantially by conduction. The housing may comprise an outer member and one or more interchangeable inner sleeves. Each of the inner sleeves has an inner cross-sectional diameter that is different from one another in order to accommodate different-sized containers.

The present invention is also directed to a method for rapidly chilling a beverage-filled container and the beverage therein. The beverage-filled container is placed within the housing (which may or may not have an inner sleeve) so that the cylindrical inner surface of the housing surrounds and is directly adjacent to the cylindrical outer surface of the beverage-filled container. The beverage-filled container is then allowed to remain within the housing at least until the beverage therein is sufficiently chilled.

BRIEF DESCRIPTION OF THE DRAWINGS

Illustrative and presently preferred embodiments of the invention are illustrated in the drawings in which.

DETAILED DESCRIPTION OF THE PREFERRED EMBODIMENTS

Figure 1:
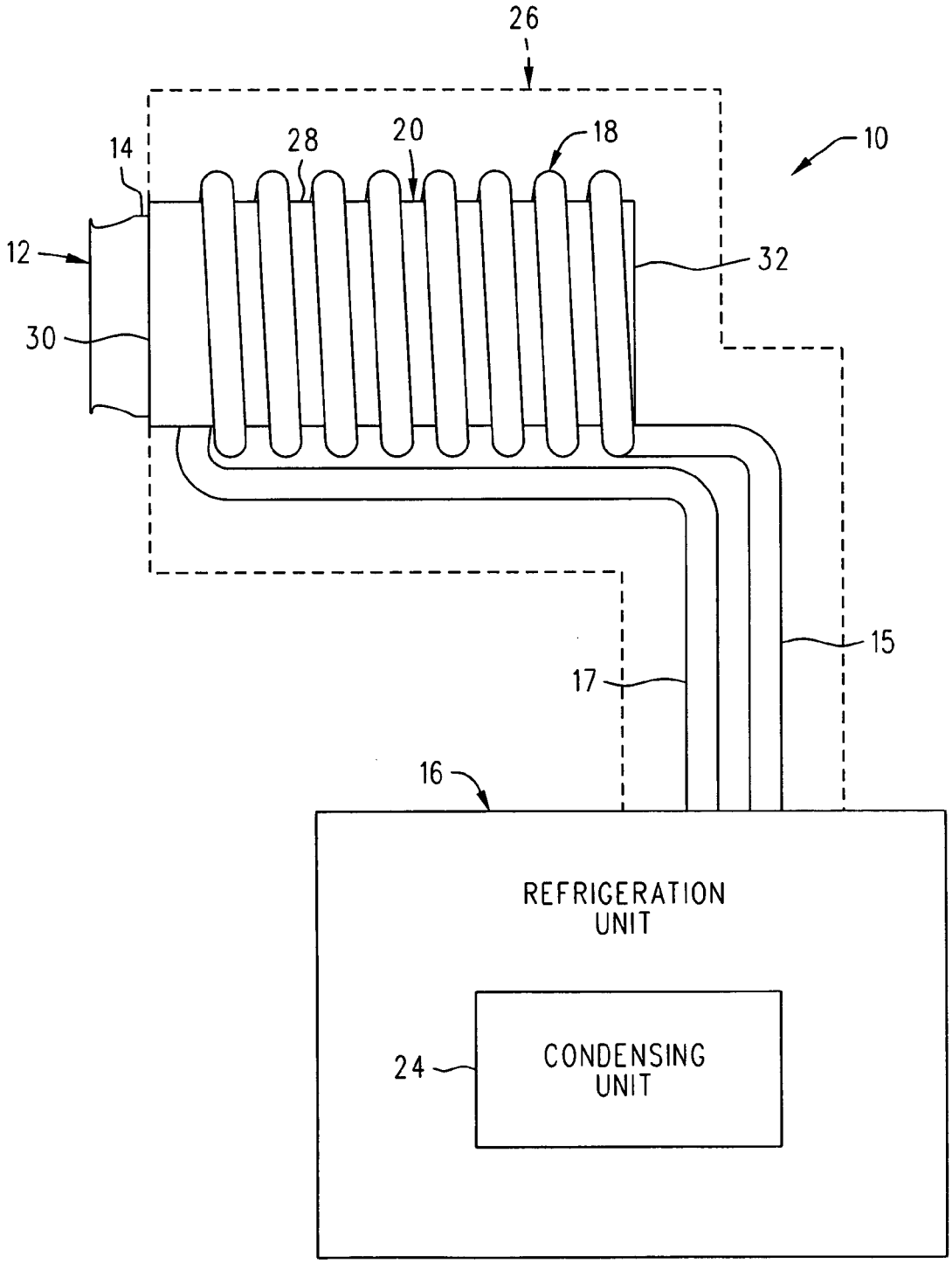
FIG. 1 is a partially schematic side view of an apparatus for rapidly chilling a beverage-filled container and the beverage therein of the present invention.
Figure 2:
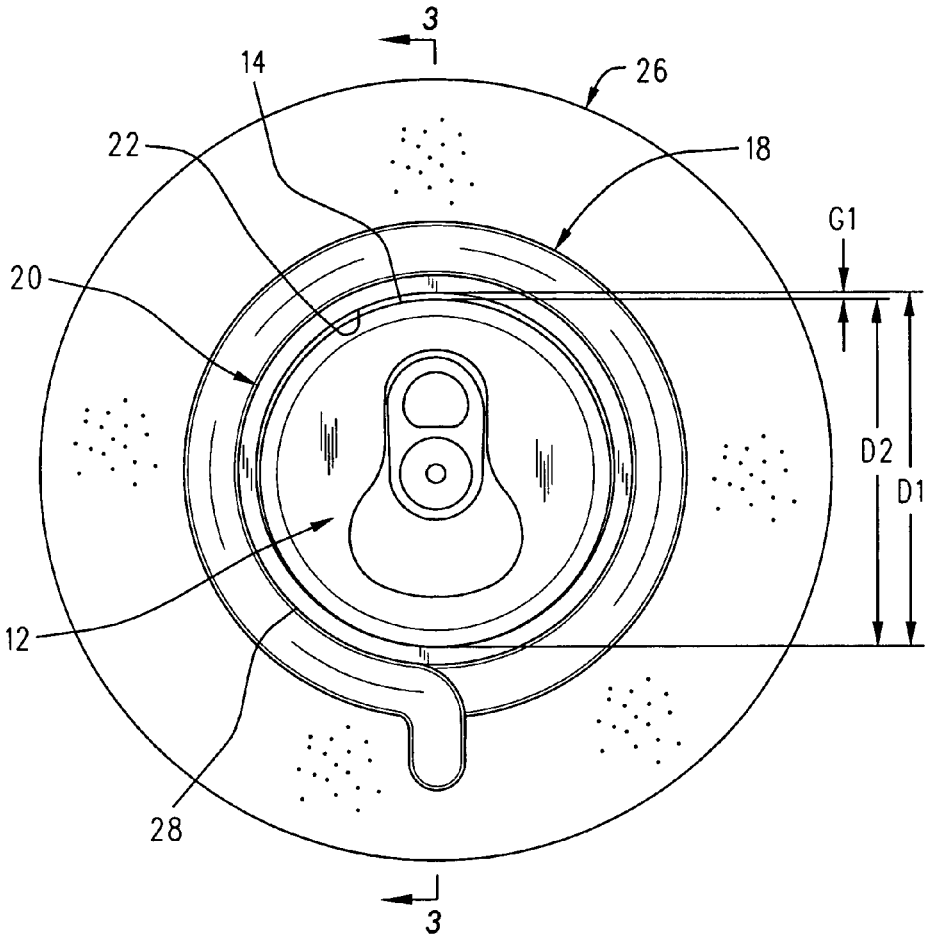
FIG. 2 is a front view of a portion of the apparatus of FIG. 1 including a cooling coil.
Figure 3:
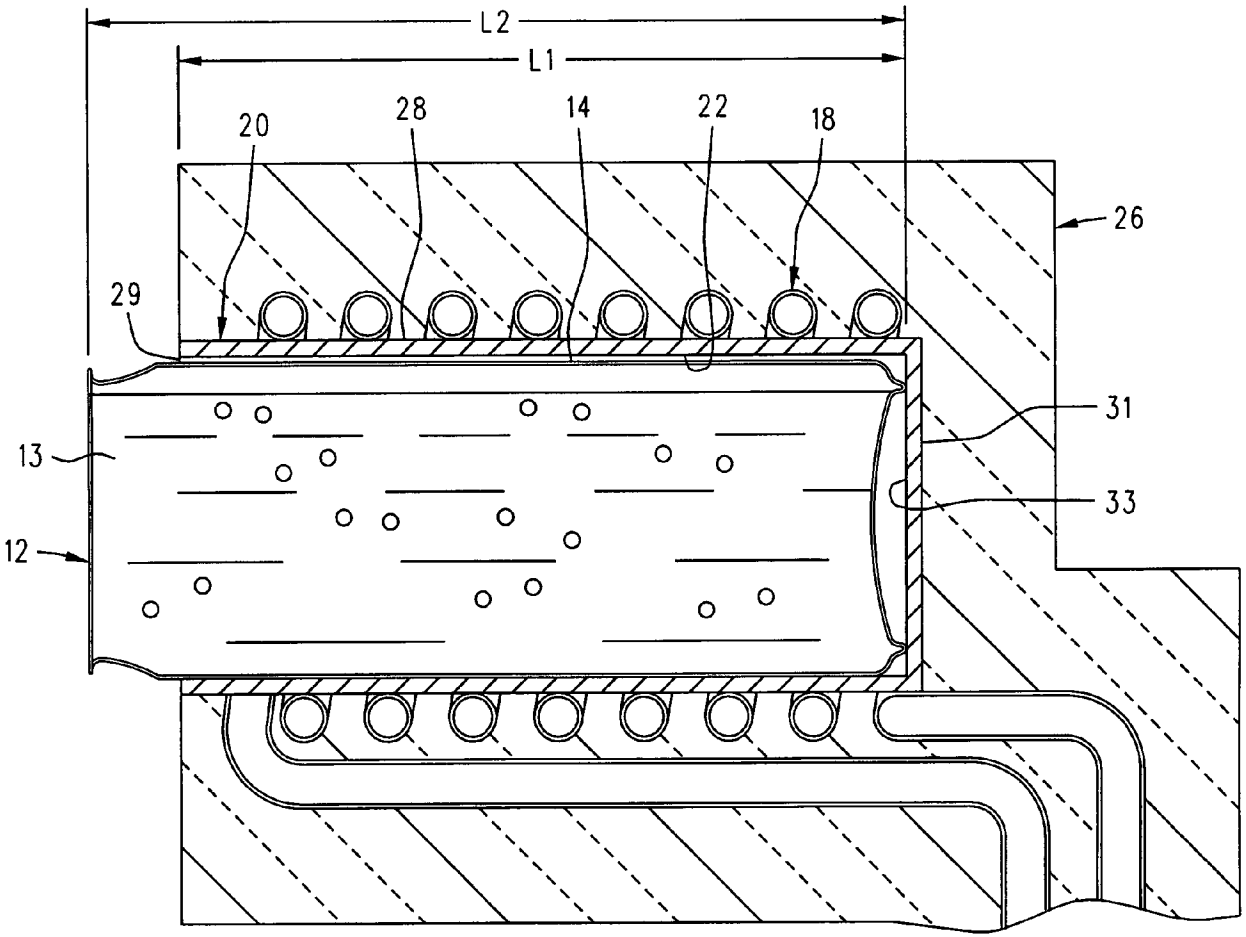
FIG. 3 is a cross-sectional view of the portion of the apparatus shown in FIG. 2.

FIGS. 1-3 illustrate a first embodiment of an apparatus 10 for rapidly chilling a beverage-filled container 12 and the beverage 13 therein which may be, for example, a carbonated beverage such as beer. The apparatus comprises a refrigeration unit 16 operatively connected via lines 15, 17 to a cooling coil 18. The cooling coil 18 surrounds and is in direct contact with a housing 20. As described in further detail below relative to FIGS. 2-7, the housing 20 may have a cylindrical inner surface 22 that conforms generally to the cylindrical outer surface 14 of the beverage-filled container 12 such that the container 12 fits snugly within the housing 20 yet is easily insertable into and removable from the housing 20.

The refrigeration unit 16 may be of a type well-known in the art and may comprise a standard condensing unit 24 such as, for example, condensing unit Model No. AZA0370YXAXA supplied by International Carbonic, Inc. ("ICI") of California. A supply of refrigerant (not shown) is circulated under pressure within the cooling coil 18 and condensing unit 24. The refrigerant is preferably of the type used for very cold refrigeration, for example a freon with a rating of R-134a that is available from DuPont Fluorochemicals, Inc., under the brand name "Suva". Using such a refrigerant, when a beverage-filled container 12 is placed within the housing 20, the container 12 and beverage 13 therein can be chilled from a first temperature "T1" to a second temperature "T2" within a period of time equal to approximately 3 minutes, wherein T1-T2 is approximately 8-10 degrees F. For example, if a beverage-filled container 12 removed from a standard cooler has a first temperature "T1" of approximately 40-42 degrees F., the container 12 and beverage 13 therein may be chilled by the apparatus 10 to a second temperature "T2" of approximately 32 degrees F. in approximately 3 minutes.

The cooling coil 18, which may consist of a standard hollow copper coil, and at least a portion of the lines 15, 17 that extend from the cooling coil 18 may be wrapped in insulation 26 (shown in dashed lines in FIG. 1). Wrapping the cooling coil 18 and the lines 15, 17 in insulation 26 does make the apparatus 10 more efficient in that it prevents undesired heat exchange between the cooling coil 18 and lines 15, 17 and the surrounding atmosphere. However, if insulation 26 is not utilized, then a thick layer of frost develops on the cooling coil 18 and at least a portion of the lines 15, 17 that may be aesthetically pleasing to a customer who wishes to rapidly chill a beverage-filled container 12 and the beverage 13 therein.

The housing 20 has an outer surface 28 around which the cooling coil 18 may be helically wound. More specifically, the cooling coil 18 may be helically wound, and then the housing 20 may be press-fit or otherwise secured within the cooling coil 18. The housing 20 has at least one open end 29 through which the container 12 may be inserted and removed. The opposite end 31 of the housing 20 may also be open, but it is preferably closed in order to allow more of the housing (namely, the inside surface 33, FIG. 3 of the closed end 32) to contact or be directly adjacent to the container 12 in order to assist in conductive chilling thereof. As best shown in FIG. 2, the cross-sectional shape of the outer surface 28 may be circular, as shown, or it may be any other shape such as, for example, oval or square. As noted above, the cooling coil 18 is preferably positioned in direct contact with the outer surface 28 of the housing 20 and may be helically coiled or otherwise wrapped therearound. Also as noted above, the housing 20 further comprises a cylindrical inner surface 22 that generally conforms to the cylindrical outer surface 14 of a beverage-filled container 12. More specifically, the diameter "D1" (FIG. 2) of the cylindrical inner surface 22 of the housing 20 is preferably slightly larger than the diameter "D2" of the cylindrical outer surface 14 of a beverage-filled container 12 so that the beverage-filled container 12 may be easily inserted into and removed from the housing 20 (for containers 12 where the diameter is irregular as shown in FIG. 3, the "diameter" as discussed herein is defined as the largest diameter on the container 12). For example, for containers 12 such as cans or bottles, "D1" may be between about 2¼ inches and 3 inches and "D2" may be between about 2⁷⁄₃₂ inches and 2³¹⁄₃₂ inches. However, when a beverage-filled container 12 is positioned within the housing 20, the cylindrical inner surface 22 of the housing 20 is also preferably directly adjacent to or only slightly spaced away from at least a substantial portion of the cylindrical outer surface 14 of the beverage-filled container 12 in order to rapidly chill the beverage-filled container 12 and the beverage 13 therein substantially by conduction. More specifically, as shown in FIG. 2, in order to chill the beverage-filled container 12 and the beverage therein substantially by conduction while allowing the container 12 to be easily inserted into and removed from the housing 20, there may be a small gap "G1" (the gap being exaggerated in the drawings for illustrative purposes) no greater than, for example, ¹⁄₆₄ inch between the cylindrical outer surface 14 of the beverage-filled container 12 and the cylindrical inner surface 22 of the housing 20. Thus, some convection cooling will occur between the cylindrical outer surface 14 of the beverage-filled container 12 and the cylindrical inner surface 22 of the housing 20 due to the necessity of providing a housing 20 that allows a container 12 to be easily inserted into and removed therefrom, as well as the fact that such containers 12 typically have imperfections and do not have perfectly round cross-sectional shapes. However, by using a housing 20 that provides a relatively tight fit for an inserted container 12, a substantial amount of the desired chilling will occur by conduction between their surfaces 14, 22. For purposes of the present discussion including the claims, the phrases "generally conforms to" and "directly adjacent to" as applied to two surfaces (e.g., surfaces 14, 22) are defined as directly contacting or being positioned a relatively small distance apart (e.g., "G1") from one another while still retaining a substantial conductive connection between the surfaces (e.g., 14, 22). In addition, the length "L1" (FIG. 3) of the cylindrical inner surface 22 of the housing 20 is preferably somewhat smaller than the length "L2" of a container 12 so that the container 12 may still be easily grasped and removed when the container 12 is fully inserted into the housing 20, while as much as possible of the container 12 is preferably surrounded by the housing 20 in order to maximize the chilling thereof. For example, in order to rapidly chill containers 12 such as cans or bottles, "L1" may be between about 6½ inches and 7 inches.

Figure 4:
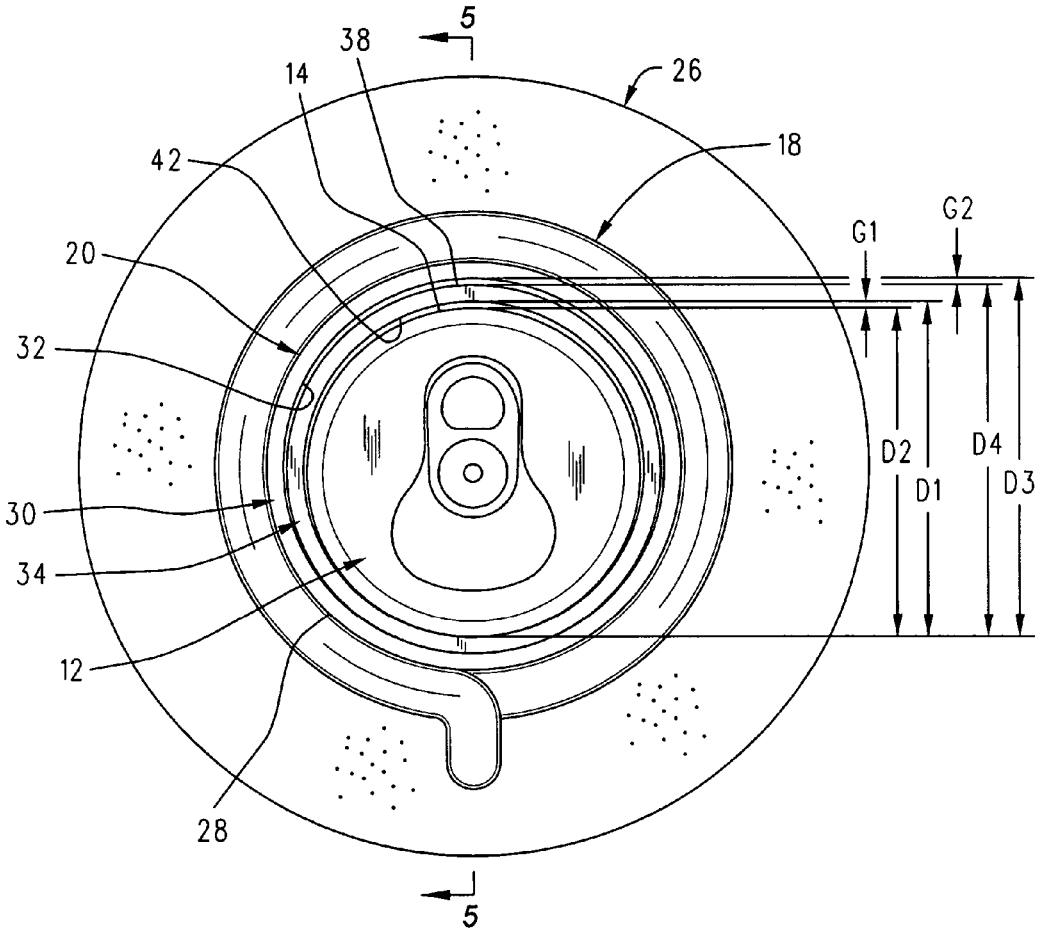
FIG. 4 is a front view of another embodiment of the portion of the apparatus shown in FIG. 1.
Figure 5:
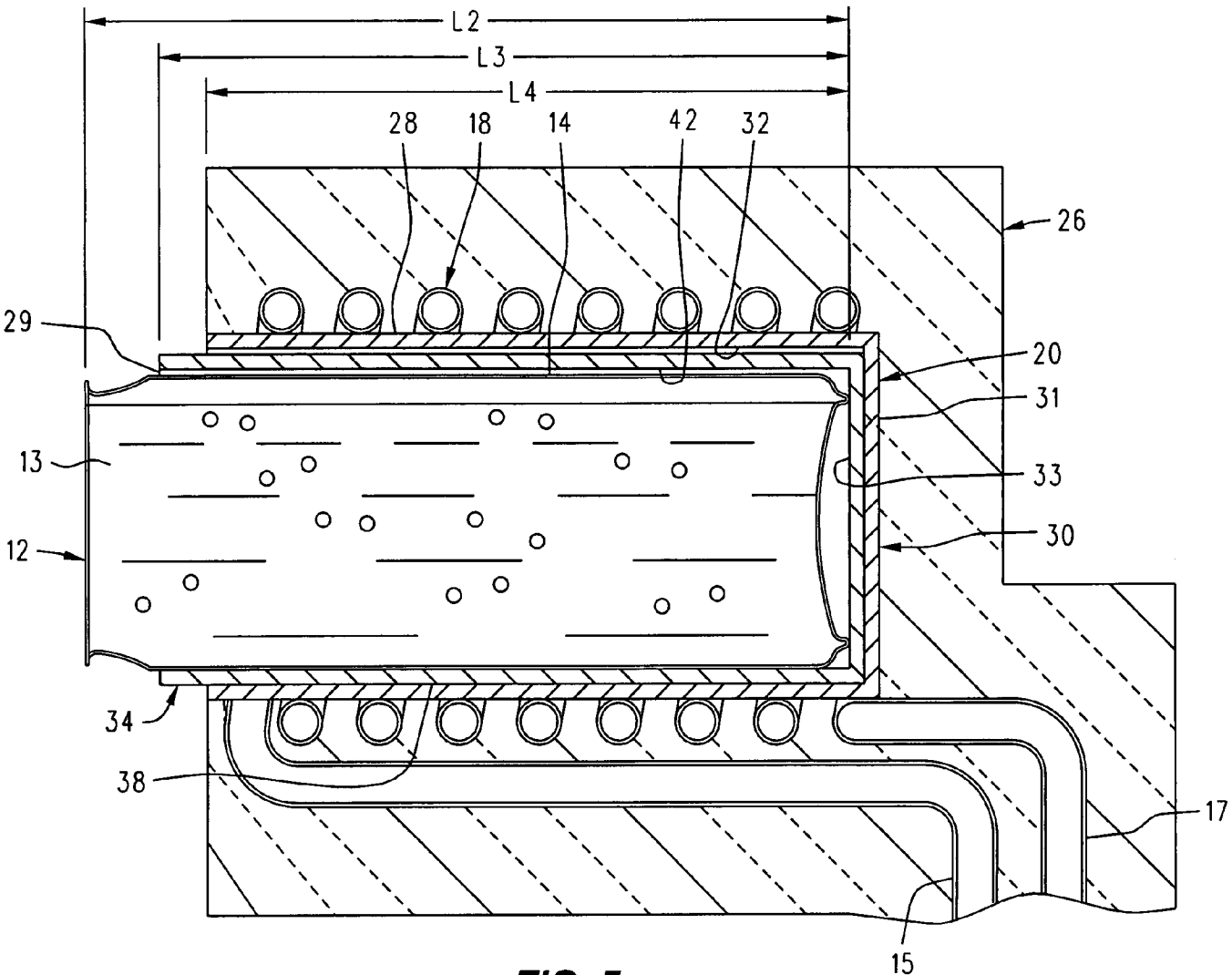
FIG. 5 is a cross-sectional view of the portion of the apparatus shown in FIG. 4.
Figure 6:
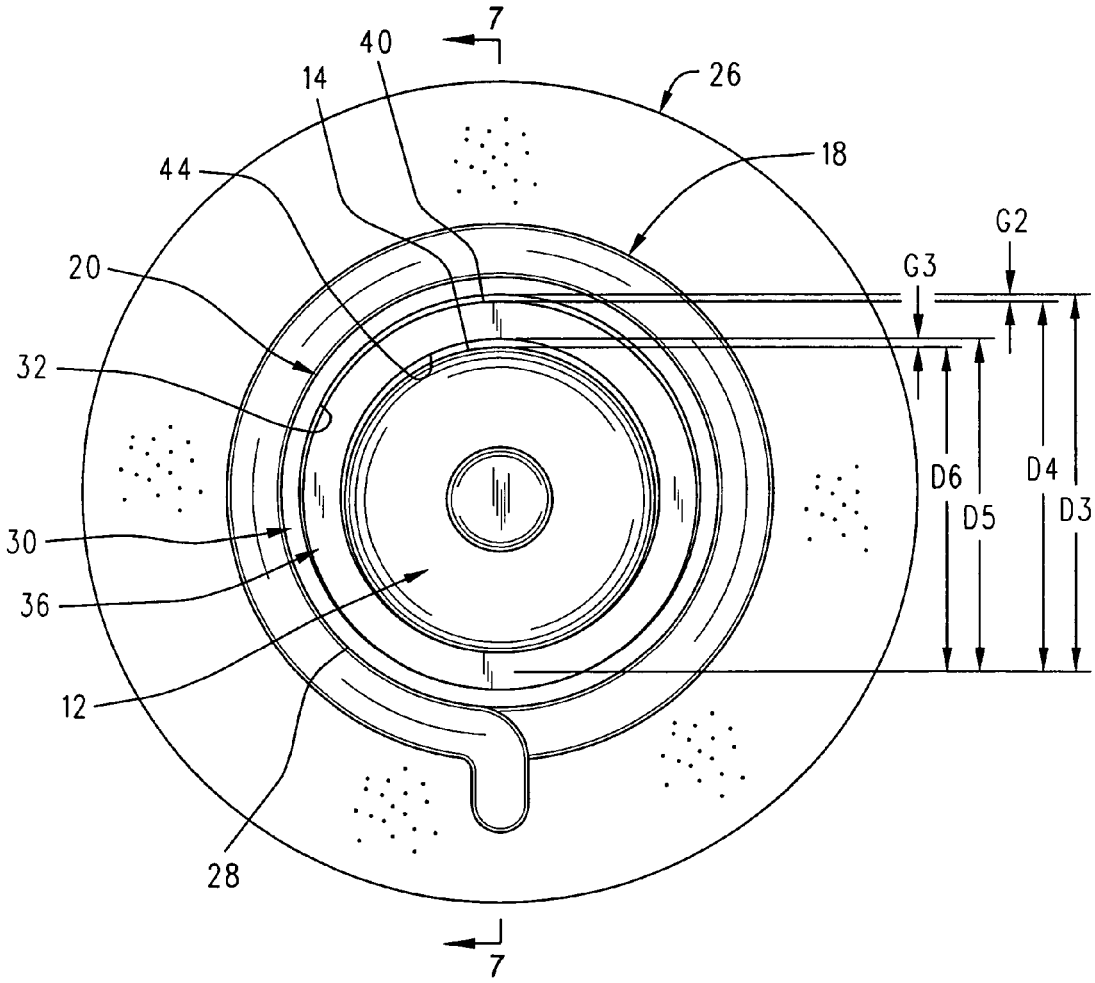
FIG. 6 is a front view of the embodiment of FIG. 4 showing another inner sleeve.
Figure 7:
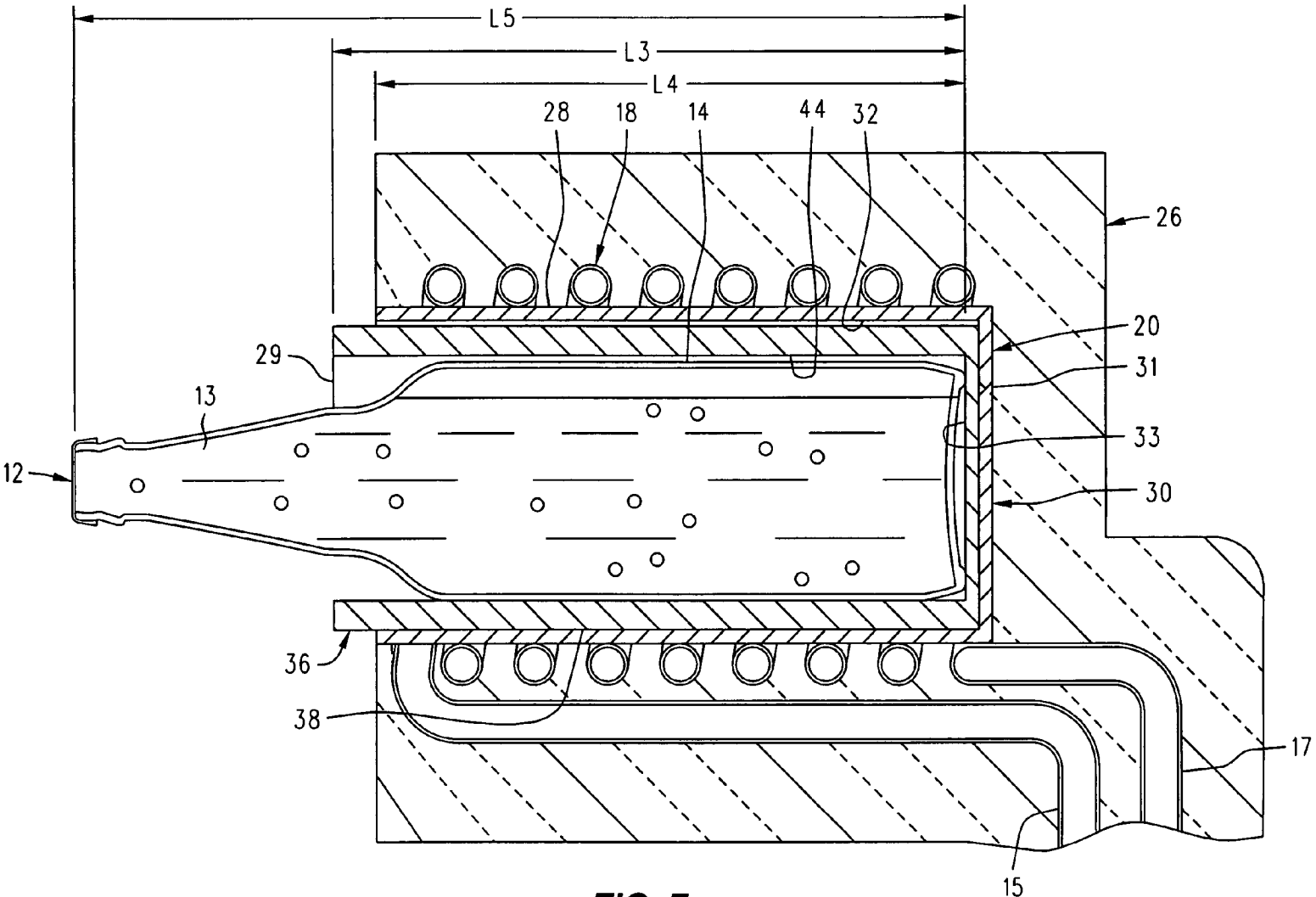
FIG. 7 is a cross-sectional view of the portion of the apparatus shown in FIG. 6.

Another embodiment is shown in FIGS. 4-7 that includes one or more inner sleeves 34 (FIGS. 4-5), 36 (FIGS. 6-7) that can accommodate different types and sizes of containers 12 such as, for example, cans (FIGS. 4-5) and bottles (FIGS. 6-7). While two sleeves 34, 36 are shown, it is to be understood that a plurality of sleeves that are interchangeable with one another may be provided. In this embodiment, the housing 20 may comprise an outer member 30 including the outer surface 28 described above that is in direct contact with the cooling coil 18 and an inner surface 32 that may have a circular cross-sectional shape as shown, or any other cross-sectional shape. The inner sleeves 34, 36 are each adapted to removably fit inside of the outer member 30. Thus, the inner sleeves 34, 36 may each have an outer surface 38, 40, respectively, that generally conforms to the inner surface 32 of the outer member 30. More specifically, the diameter "D3" (FIGS. 4 and 6) of the inner surface 32 of the outer member 30 is preferably slightly larger than the diameter "D4" of the outer surface 38, 40 of an inner sleeve 34, 36 so that the inner sleeve 34, 36 may be easily removed from and inserted into the outer member 30 of the housing 20. For example, "D3" may be between about 2⅞ inches and 3⅛ inches, and "D4" may be between about 2²⁷⁄₃₂ inches and 3³⁄₃₂ inches. However, when an inner sleeve 34, 36 is positioned within the outer member 30 of the housing 20, the inner surface 32 of the outer member 30 is also preferably directly adjacent to or only slightly spaced away from at least a substantial portion of the outer surface 38, 40 of the inner sleeve 34, 36 in order to maintain substantial conductive contact therebetween. In particular, there may be a small gap "G2" (the gap being exaggerated in the drawings for illustrative purposes) no greater than, for example, ¹⁄₆₄ inch between the outer surface 38, 40 of the sleeve 34, 36 and the inner surface 32 of the outer member 30 of the housing 20. Thus, some convection cooling will occur between the inner surface 32 of the outer member 30 and the outer surface 38, 40 of an inner sleeve 34, 36 due to the necessity of providing an outer member 30 that allows an inner sleeve 34, 36 to be easily inserted into and removed therefrom. However, there is preferably a relatively tight fit between the outer member 30 and inner sleeve 34, 36, so that a substantial amount of the desired chilling will occur by conduction between their surfaces 32 and 38, 40. Again, for purposes of the present discussion including the claims, the phrases "generally conforms to" and "directly adjacent to" as applied to two surfaces (e.g., surfaces 38, 40 and 32) are defined as directly contacting or being positioned a relatively small distance apart (e.g., "G2") from one another while still retaining a substantial conductive connection between the surfaces.

Referring specifically to FIG. 4, an inner sleeve 34 may have a cylindrical inner surface 42 that generally conforms to the cylindrical outer surface 14 of a beverage-filled container 12 such as a can. More specifically, like the embodiment shown in FIGS. 1-3, the diameter "D1" of the cylindrical inner surface 42 of the sleeve 34 is preferably slightly larger than the diameter "D2" of the cylindrical outer surface 14 of a beverage-filled container 12 so that the beverage-filled container 12 may be easily inserted into and removed from the inner sleeve 34 (for containers 12 where the diameter is irregular as shown in FIG. 5, the "diameter" as discussed herein is defined as the largest diameter on the container 12). As with the surfaces 14, 22 described above, there may be a small gap "G1" (the gap being exaggerated in the drawings for illustrative purposes) between the cylindrical outer surface 14 of the beverage-filled container 12 and the cylindrical inner surface 42 of the sleeve 34. Again, some convection cooling will occur between the cylindrical inner surface 42 of the sleeve 34 and the cylindrical outer surface 14 of a beverage-filled container 12 due to the necessity of providing an inner sleeve 34 that allows a container 12 to be easily inserted into and removed therefrom, as well as the fact that such containers 12 typically have imperfections and do not have perfectly round cross-sectional shapes. However, by using an inner sleeve 34 that provides a relatively tight fit for an inserted container 12, a substantial amount of the desired chilling will occur by conduction between their surfaces 14, 42.

Referring now to FIG. 6, another sleeve 36 may have a cylindrical inner surface 44 that generally conforms to the outer surface 14 of a beverage-filled container 12 such as a bottle. More specifically, the diameter "D5" of the cylindrical inner surface 44 of the sleeve 36 is preferably slightly larger than the diameter "D6" of the outer surface 14 of a beverage-filled container 12 so that the beverage-filled container 12 may be easily inserted into and removed from the inner sleeve 36 (again, for containers 12 where the diameter is irregular as shown in FIG. 7 such as is typically the situation with a bottle, the "diameter" as discussed herein is defined as the largest diameter on the container 12). There may be a small gap "G3" (the gap being exaggerated in the drawings for illustrative purposes) no greater than, for example, 1/64 inch between the cylindrical outer surface 14 of the beverage-filled container 12 and the cylindrical inner surface 44 of the sleeve 36. Like with the sleeve 34, some convection cooling will occur between the cylindrical inner surface 44 of the sleeve 36 and the cylindrical outer surface 14 of a beverage-filled container 12 due to the necessity of providing an inner sleeve 36 that allows a container 12 to be easily inserted into and removed therefrom, as well as the fact that such containers 12 typically have imperfections and do not have perfectly round cross-sectional shapes, and often have irregular cross-sectional diameters as shown in FIG. 7. However, by using an inner sleeve 36 that provides a relatively tight fit for an inserted container 12, a substantial amount of the desired chilling will occur by conduction between their surfaces 14, 44. Again, many different sleeves may be provided that have different inner cross-sectional diameters (e.g., "D1", "D5") in order to accommodate many different sizes and types of containers 12, but with the same outer cross-sectional diameter in order to be removably insertable into the outer member 30 of the housing 20 while still maintaining substantial conductive contact therebetween.

With any sleeve 34, 36, or the like, the length "L3" (FIGS. 5 and 7) of the cylindrical inner surface 42, 44 thereof is preferably smaller than the length "L2" (FIG. 5), "L5" (FIG. 7) of any container 12 that may be placed inside a sleeve 34, 36 so that the container 12 may still be easily grasped and removed when the container 12 is fully inserted into the sleeve 34, 36. However, as noted above, a substantial portion of the container 12 is preferably surrounded by the inner sleeve 34, 36 in order to maximize the chilling thereof. For example, "L3" may be between about 6 inches and 7 inches, while "L2" and "L5" may vary greatly depending on the container. Each sleeve 34, 36, and the like may have the same length or different lengths (preferably within the above-described ranges) to accommodate different-sized containers 12. However, the length "L4" of the inner surface 32 of the outer member 30 is preferably smaller than the length "L3" of the cylindrical inner surface 42, 44 of any sleeve 34, 36 so that the sleeve 34, 36 may still be easily grasped and removed when the sleeve 34, 36 is fully inserted into the outer member 30. For example, "L4" may be between about 4½ inches and 5½ inches.

With reference to FIGS. 1-7, the present invention is also directed to a method for rapidly chilling a beverage-filled container 12 and the beverage 13 therein utilizing an apparatus 10 of type described in any of the embodiments above. A beverage-filled container 12 is placed within the housing 20 of the apparatus 10 through an open end 29 thereof. When placed inside the housing 20, the cylindrical inner surface 22 of the housing surrounds and is directly adjacent to the cylindrical outer surface 14 of the beverage-filled container 12. If the apparatus 10 includes an inner sleeve 34, 36 (FIGS. 4-7), the beverage-filled container 12 may first be placed within an appropriate-sized inner sleeve 34, 36, and then the inner sleeve 34, 36 may then be placed within the outer member 30 of the housing 20. Alternatively, and equally as effective, an appropriate-sized inner sleeve 34, 36 may first be placed inside the outer member 30 of the housing 20, and then the beverage-filled container 12 may then be placed within the inner sleeve 34, 36. Either way, the beverage-filled container 12 is allowed to remain within the housing 20 at least until the beverage 13 therein, which has a first temperature "T1", is sufficiently chilled to a second temperature "T2" substantially by conduction. As noted above, the difference between the first temperature and the second temperature (T1-T2) may be approximately 8 degrees F., and this temperature reduction may be accomplished in approximately 3 minutes. For example, if a beverage-filled container 12 removed from a standard cooler has a first temperature "T1" of approximately 40-42 degrees F., the container 12 and beverage 13 therein may be chilled by the apparatus 10 to a second temperature "T2" of approximately 30-34 degrees F. in approximately 3 minutes.

While illustrative and presently preferred embodiments of the invention have been described in detail herein, it is to be understood that the inventive concepts may be otherwise variously embodied and employed, and that the appended claims are intended to be construed to include such variations, except as limited by the prior art.

I claim:

1. An apparatus for rapidly chilling a beverage-filled container and the beverage therein, said container having a cylindrical outer surface, comprising:

a) a housing having a cylindrical inner surface that generally conforms to said cylindrical outer surface of said beverage-filled container, an outer surface, and at least one open end to receive said beverage-filled container;

b) a cooling coil surrounding and directly adjacent to said outer surface of said housing;

c) a refrigeration unit operatively connected to said cooling coil;

d) wherein, when said beverage-filled container is positioned within said housing, said cylindrical inner surface of said housing surrounds and is directly adjacent to at least a portion of said cylindrical outer surface of said beverage-filled container in order to rapidly chill said beverage-filled container and said beverage therein substantially by conduction.

2. The apparatus of claim 1, wherein said refrigeration unit comprises:

a) a condensing unit in fluid connection with said cooling coil; and b) a supply of refrigerant circulating under pressure within said cooling coil and said condensing unit, said refrigerant being freon having a rating of R-134a, wherein said apparatus chills said beverage within said beverage-filled container, which has a first temperature, to a second temperature that is approximately 8-10 degrees F. colder than said first temperature within a period of time equal to approximately 3 minutes.

3. The apparatus of claim 1, said housing having an outer member including said outer surface and an inner sleeve including said cylindrical inner surface, wherein said inner sleeve is removably inserted within said outer member and comprises at least one open end.

4. The apparatus of claim 3, said cylindrical inner surface of said inner sleeve substantially conforming to a cylindrical outer surface of a beverage can.

5. The apparatus of claim 3, said cylindrical inner surface of said inner sleeve substantially conforming to a cylindrical outer surface of a beverage bottle.

6. The apparatus of claim 1, said housing having a length that is smaller than the length of said beverage container to allow said beverage container to extend from said housing.

7. An apparatus for rapidly chilling a beverage-filled container and the beverage therein, said container having a cylindrical outer surface, comprising:

a) a housing having an outer member with an outer surface, an inner sleeve with at least one open end and a cylindrical inner surface that generally conforms to said cylindrical outer surface of said beverage-filled container, and at least one open end to removably receive said inner sleeve within said outer member;

b) a cooling coil surrounding and directly adjacent to said outer surface of said outer member of said housing;

c) a condensing unit in fluid connection with said cooling coil; and d) a supply of refrigerant circulating under pressure within said cooling coil and said condensing unit;

e) wherein, when said beverage-filled container is positioned within said housing, said cylindrical inner surface of said inner sleeve surrounds and is directly adjacent to said cylindrical outer surface of said beverage-filled container in order to rapidly chill said beverage-filled container and said beverage therein substantially by conduction.

8. The apparatus of claim 7, said refrigerant being freon having a rating of R-134a, wherein said apparatus chills said beverage within said beverage-filled container, which has a first temperature, to a second temperature that is approximately 8-10 degrees F. colder than said first temperature within a period of time equal to approximately 3 minutes.

9. The apparatus of claim 7, said cylindrical inner surface of said inner sleeve substantially conforming to a cylindrical outer surface of a beverage can.

10. The apparatus of claim 7, said cylindrical inner surface of said inner sleeve generally substantially conforming to a cylindrical outer surface of a beverage bottle.

11. The apparatus of claim 7 further comprising a plurality of inner sleeves that are interchangeable with said inner sleeve, wherein each of said inner sleeves has a cylindrical inner surface with a cross-sectional diameter that is different from each other.

12. A method for rapidly chilling a beverage-filled container and the beverage therein, said container having a cylindrical outer surface, comprising:

a) providing an apparatus comprising:

i) a housing having a cylindrical inner surface that generally conforms to said cylindrical outer surface of said beverage-filled container, an outer surface, and at least one open end to receive said beverage-filled container;

ii) a cooling coil surrounding and directly adjacent to said outer surface of said housing; and iii) a refrigeration unit operatively connected to said cooling coil;

b) placing said beverage-filled container within said housing through said at least one open end thereof such that said cylindrical inner surface of said housing surrounds and is directly adjacent to said cylindrical outer surface of said beverage-filled container; and c) allowing said beverage-filled container to remain within said housing at least until said beverage therein, which has a first temperature, is sufficiently chilled to a second temperature substantially by conduction.

13. The method of claim 12, said beverage-filled container extending from said at least one open end of said housing a sufficient distance in order to grasp said beverage-filled container.

14. The method of claim 12, said beverage being sufficiently chilled within a period of time equal to approximately 3 minutes, and wherein said second temperature is approximately 8-10 degrees F. colder than said first temperature.

15. The method of claim 12, said housing further comprising an outer member and at least one inner sleeve that is removable from said outer member, and wherein said placing said beverage-filled container within said housing comprises placing said beverage-filled container within said inner sleeve.

* * * * *